US007059701B2

(12) United States Patent
Deer et al.

(10) Patent No.: US 7,059,701 B2
(45) Date of Patent: Jun. 13, 2006

(54) METHOD FOR CALIBRATING PRODUCTION PRINTING CARTRIDGES FOR USE IN AN IMAGING SYSTEM

(75) Inventors: Anna Yaping Deer, Lexington, KY (US); Xuan-Chao Huang, Lexington, KY (US); Brant Dennis Nystrom, Lexington, KY (US); Richard Lee Reel, Georgetown, KY (US)

(73) Assignee: Lexmark International, Inc., Lexington, KY (US)

( * ) Notice: Subject to any disclaimer, the term of this patent is extended or adjusted under 35 U.S.C. 154(b) by 289 days.

(21) Appl. No.: 10/800,571

(22) Filed: Mar. 15, 2004

(65) Prior Publication Data

US 2005/0200646 A1 Sep. 15, 2005

(51) Int. Cl.
*B41J 29/393* (2006.01)

(52) U.S. Cl. ..... 347/19; 358/1.9

(58) Field of Classification Search ..... 347/19, 347/20

See application file for complete search history.

(56) References Cited

U.S. PATENT DOCUMENTS 4,975,862 A 12/1990 Keller et al.
5,355,440 A 10/1994 Sayanagi et al.
5,502,580 A 3/1996 Yoda et al.
5,526,140 A 6/1996 Rozzi
5,748,858 A 5/1998 Ohtsuka et al.
5,832,109 A 11/1998 Mahy
5,835,244 A 11/1998 Bestmann
6,094,280 A * 7/2000 Hayasaki et al. ..... 358/1.9
6,178,007 B1 1/2001 Harrington
6,178,008 B1 * 1/2001 Bockman et al. ..... 358/1.9
6,351,320 B1 2/2002 Shin
6,381,037 B1 4/2002 Balasubramanian et al.
6,386,674 B1 * 5/2002 Corrigan et al. ..... 347/19
6,404,509 B1 * 6/2002 Kuwata et al. ..... 358/1.9
6,585,340 B1 * 7/2003 Borrell ..... 347/14
6,789,876 B1 * 9/2004 Barclay et al. ..... 347/37
2001/0038459 A1 11/2001 Mahy
2002/0149785 A1 * 10/2002 Chu et al. ..... 358/1.9
2002/0180996 A1 12/2002 Allen et al.
2002/0180998 A1 12/2002 Wu
2003/0025925 A1 2/2003 Elsman et al.
2003/0058459 A1 3/2003 Wu et al.
2003/0063338 A1 4/2003 Gaudaitis et al.
2003/0065491 A1 4/2003 Roberts
2003/0081214 A1 5/2003 Mestha et al.
2003/0086102 A1 5/2003 Soler et al.
2003/0086103 A1 5/2003 Mestha et al.
2003/0098896 A1 5/2003 Berns et al.
2003/0103103 A1 6/2003 Smith
2003/0122891 A1 * 7/2003 Hamamoto et al. ..... 347/23
2003/0202192 A1 * 10/2003 Kuwata et al. ..... 358/1.9

(Continued)

*Primary Examiner*—K. Feggins
*Assistant Examiner*—Rene Garcia, Jr.
(74) *Attorney, Agent, or Firm*—Ronald K. Aust

(57) ABSTRACT

A method for calibrating a production printing cartridge for use in an imaging system includes the steps of obtaining first standard cartridge signature color data associated with a standard printing cartridge and a first substrate, obtaining second standard cartridge signature color data associated with the standard printing cartridge and a second substrate, obtaining first production cartridge signature color data associated with the production printing cartridge and the first substrate, and estimating second production cartridge signature color data associated with the production printing cartridge and the second substrate based on the first standard cartridge signature color data, the second standard cartridge signature color data, and the first production cartridge signature color data.

30 Claims, 6 Drawing Sheets

U.S. PATENT DOCUMENTS

2004/0001209 A1* 1/2004 Chu et al. ..... 358/1.9
2004/0001210 A1* 1/2004 Chu et al. ..... 358/1.9
2004/0021711 A1* 2/2004 Hasseler et al. ..... 347/7
2005/0073731 A1* 4/2005 Deer et al. ..... 358/518

* cited by examiner

METHOD FOR CALIBRATING PRODUCTION PRINTING CARTRIDGES FOR USE IN AN IMAGING SYSTEM

BACKGROUND OF THE INVENTION

1. Field of the Invention

The present invention relates to an imaging system, and, more particularly, to a method for calibrating production printing cartridges for use in an imaging system.

2. Description of the Related Art

In recent years, the use of computers for home and business purposes has increased significantly. Computer systems typically incorporate a computer monitor, a scanner, and a printer. Users frequently employ such systems for scanning, modifying, and/or creating various color documents. The documents may include personal greeting cards, photographs, pamphlets, flyers, brochures, iron-on transfers to clothing, business presentations, business cards, and other personal or business related documents. Such color documents are usually reproduced on a substrate using a personal or business printer, and distributed to various recipients, such as family or friends, or individual/business consumers. It is desirable that the reproduced documents appear consistent, notwithstanding the use of different printing cartridges.

However, a color shift usually occurs from one printing cartridge to another, and from one substrate to another, which is a common problem in color reproduction. This problem is particularly acute for photo paper printing. Accordingly, manufacturers of printing cartridges typically calibrate each production printing cartridge for many different types of substrates, each of which may thus be referred to as a factory-supported substrate. For example, each printing cartridge is typically calibrated for printing on plain paper, photo paper, coated ink jet paper, greeting card stock, transparency stock for use with overhead projectors, iron-on transfer material for use in transferring an image to an article of clothing, and back-lit film for use in creating advertisement displays and the like.

In cartridge manufacturing, each printing cartridge is calibrated individually, and the calibration information is provided in the printer's driver software for color correction of the printing cartridge. The printer driver software, also referred to as imaging driver software, is usually provided to the customer in the form of a floppy disk or CD-ROM with the purchase of the printer, and normally supports printing on many different substrates. However, if the calibration is performed on every substrate for each cartridge, the unit cost for each printing cartridge will be high, due to the labor involved in performing the calibration, as well as the cost of the substrates used in the calibration process.

What is needed in the art is a method for calibrating production printing cartridges for use in an imaging system.

SUMMARY OF THE INVENTION

The present invention provides a method for calibrating production printing cartridges for use in an imaging system.

The invention, in one form thereof, relates to a method for calibrating a production printing cartridge for use in an imaging system. The method includes the steps of obtaining first standard cartridge signature color data associated with a standard printing cartridge and a first substrate; obtaining second standard cartridge signature color data associated with the standard printing cartridge and a second substrate; obtaining first production cartridge signature color data associated with the production printing cartridge and the first substrate; and estimating second production cartridge signature color data associated with the production printing cartridge and the second substrate, based on the first standard cartridge signature color data, the second standard cartridge signature color data, and the first production cartridge signature color data.

The invention, in another form thereof, relates to an imaging apparatus. The imaging apparatus includes a print engine configured to mount a production printing cartridge, and a controller communicatively coupled to the print engine. The controller executes instructions to perform the steps of acquiring first standard cartridge signature color data associated with a standard printing cartridge and a first substrate, acquiring second standard cartridge signature color data associated with the standard printing cartridge and a second substrate, acquiring first production cartridge signature color data associated with the production printing cartridge and the first substrate, and estimating second production cartridge signature color data associated with the production printing cartridge and the second substrate based on the first standard cartridge signature color data, the second standard cartridge signature color data, and the first production cartridge signature color data.

An advantage of this invention is that the cost of calibrating a printing cartridge for color correction may be reduced.

Another advantage of the present invention is that it aids in maintaining color consistency in color reproduction while reducing the cartridge manufacturing cost.

Still another advantage of the present invention is that the size of the printing cartridge memory may be reduced.

BRIEF DESCRIPTION OF THE DRAWINGS

The above-mentioned and other features and advantages of this invention, and the manner of attaining them, will become more apparent, and the invention will be better understood by reference to the following description of an embodiment of the invention taken in conjunction with the accompanying drawings, wherein.

Corresponding reference characters indicate corresponding parts throughout the several views. The exemplifications set out herein illustrate an embodiment of the invention and such exemplifications are not to be construed as limiting the scope of the invention in any manner.

DETAILED DESCRIPTION OF THE INVENTION

Figure 1:
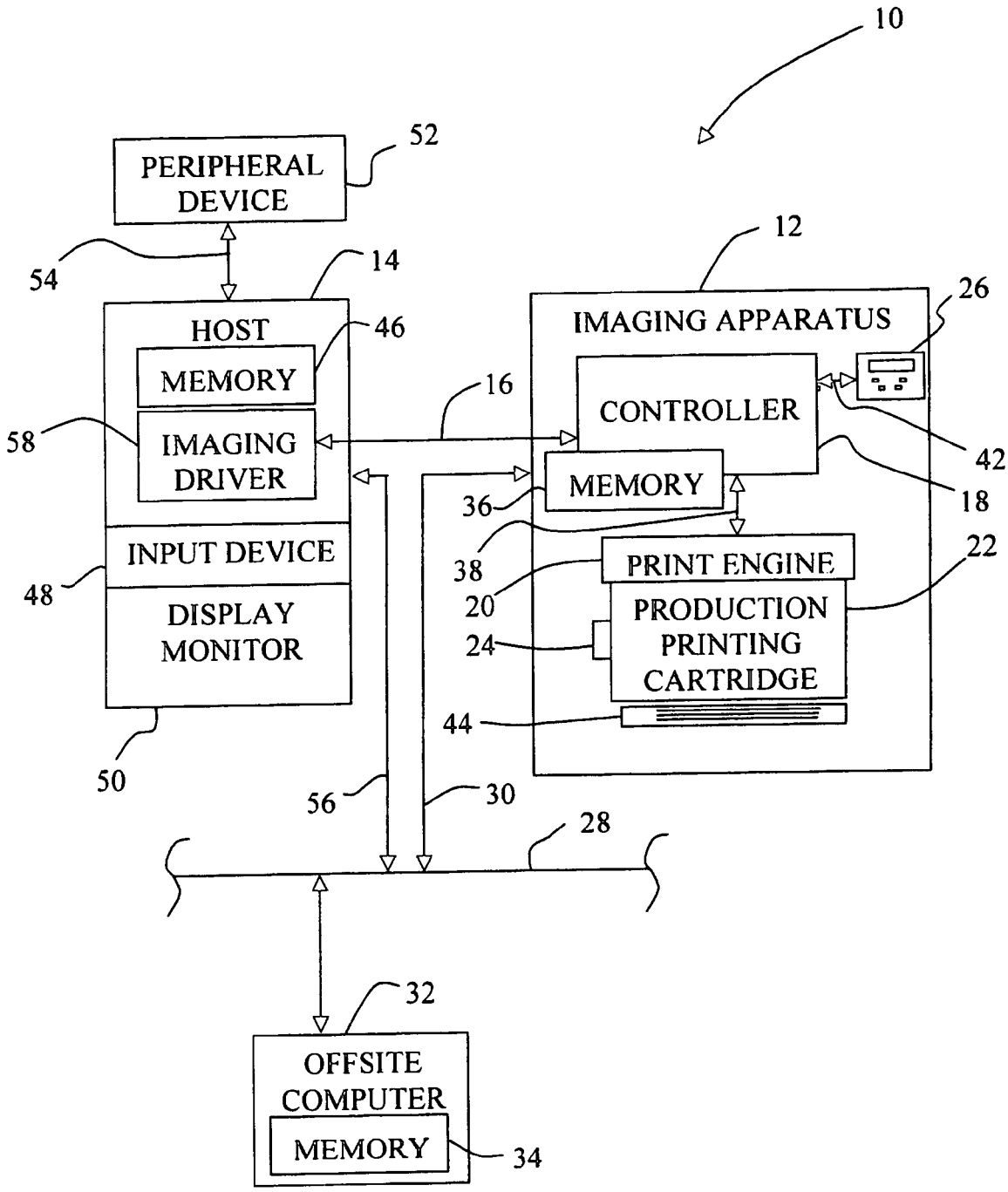
FIG. 1 is a diagrammatic depiction of an imaging system that utilizes the present invention.

Referring now to the drawings, and particularly to FIG. 1, there is shown a diagrammatic depiction of an imaging system 10 embodying the present invention. Imaging system 10 includes an imaging apparatus 12 and a host 14. Imaging apparatus 12 communicates with host 14 via a communications link 16.

Imaging apparatus 12 can be, for example, an ink jet printer and/or copier, an electrophotographic printer and/or copier, or an all-in-one (AIO) unit that includes a printer, a scanner, and possibly a fax unit. Imaging apparatus 12 includes a controller 18, a print engine 20, a printing cartridge, such as production printing cartridge 22 having cartridge memory 24, and a user interface 26. Imaging apparatus 12 has access to a network 28, such as the Internet, via a communication line 30, to interface with an offsite computer 32 having an offsite memory 34, in order to transmit and/or receive data for use in carrying out its imaging functions.

Controller 18 includes a processor unit and associated memory 36, and may be formed as one or more Application Specific Integrated Circuits (ASIC). Controller 18 may be a printer controller, a scanner controller, or may be a combined printer and scanner controller. Although controller 18 is depicted in imaging apparatus 12, alternatively, it is contemplated that all or a portion of controller 18 may reside in host 14. Controller 18 communicates with print engine 20, production printing cartridge 22, and cartridge memory 24 via a communications link 38, and with user interface 26 via a communications link 42. Controller 18 serves to process print data and to operate print engine 20 during printing.

In the context of the examples for imaging apparatus 12 given above, print engine 20 can be, for example, an ink jet print engine or a color electrophotographic print engine, configured for forming an image on a printing substrate 44, which may be one of many types of print media, such as a sheet of plain paper, fabric, photo paper, coated ink jet paper, greeting card stock, transparency stock for use with overhead projectors, iron-on transfer material for use in transferring an image to an article of clothing, and back-lit film for use in creating advertisement displays and the like. As an ink jet print engine, print engine 20 operates production printing cartridge 22 to eject ink droplets onto printing substrate 44 in order to reproduce text or images, etc. As an electrophotographic print engine, print engine 20 causes production printing cartridge 22 to deposit toner onto printing substrate 44, which is then fused to printing substrate 44 by a fuser (not shown).

Host 14 may be, for example, a personal computer, including memory 46, an input device 48, such as a keyboard, and a display monitor 50. A peripheral device 52, such as a digital camera, is coupled to host 14 via a communication link 54. Host 14 further includes a processor, input/output (I/O) interfaces, and is connected to network 28 via a communication line 56, and hence, has access to offsite computer 32, including offsite memory 34. Memory 46 can be any or all of RAM, ROM, NVRAM, or any available type of computer memory, and may include one or more of a mass data storage device, such as a floppy drive, a hard drive, a CD-ROM and/or a DVD unit, During operation, host 14 includes in its memory 46 a software program including program instructions that function as an imaging driver 58, e.g., printer/scanner driver software, for imaging apparatus 12. Imaging driver 58 is in communication with controller 18 of imaging apparatus 12 via communications link 16. Imaging driver 58 facilitates communication between imaging apparatus 12 and host 14, and provides formatted print data to imaging apparatus 12, and more particularly, to print engine 20. Although imaging driver 58 is disclosed as residing in memory 46 of host 14, it is contemplated that, alternatively, all or a portion of imaging driver 58 may be located in controller 18 of imaging apparatus 12.

Figure 2:
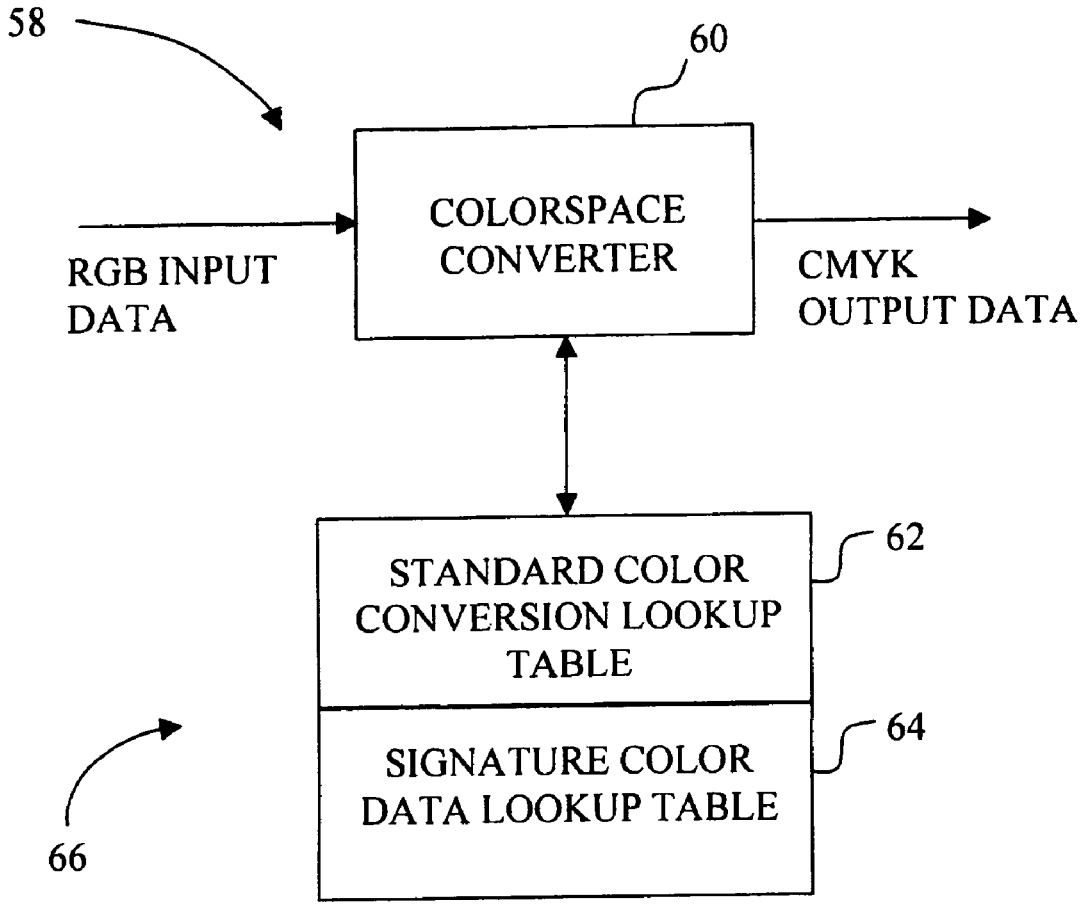
FIG. 2 is a diagrammatic depiction of a colorspace converter accessing a composite color conversion lookup table in accordance with the present invention.

Referring now to FIG. 2, imaging driver 58 includes a colorspace converter 60. Although described herein as residing in imaging driver 58, colorspace converter 60 may be in the form of firmware or software, and may reside in either imaging driver 58 or controller 18. Alternatively, some portions of colorspace converter 60 may reside in imaging driver 58, while other portions reside in controller 18.

Colorspace converter 60 is used for converting color signals from a first colorspace, such as an RGB colorspace output by display monitor 50, to a second colorspace, for example, CMYK (cyan, magenta, yellow, and black), which is used by print engine 20. The output of colorspace converter 60 may be used to provide multilevel printing, for example, CcMmYyKcm printing, which employs the following ink drop sizes/strengths/compositions: large undiluted cyan dye-based ink drops ("C"), small undiluted cyan dye-based drops ("c"), large undiluted magenta dye-based drops ("M"), small undiluted magenta dye-based ink drops ("m"), large undiluted yellow dye-based ink drops ("Y"), small undiluted yellow dye-based ink drops ("y"), undiluted black pigment-based ink drops ("K"), dilute cyan pigment-based ink drops (second occurrence in "CcMmYyKcm" of "c"), and dilute magenta pigment-based ink drops (second occurrence of "m"). It will be understood that any reference to CMYK may include any combination of the CcMmYyKcm inks, and that any reference to CMY may include any combination of CcMmYy inks.

Coupled to colorspace converter 60 are a standard color conversion lookup table 62 and a signature color data lookup table 64, which together define a composite color conversion lookup table 66. Standard color conversion lookup table 62 and composite color conversion lookup table 66 are multidimensional lookup tables having at least three dimensions, and include RGB values and CMYK values, wherein each CMYK output value corresponds to an RGB input value. Standard color conversion lookup table 62 and composite color conversion lookup table 66 may also include other data, such as spectral data.

Standard color conversion lookup table 62 is the basic color conversion lookup table accessed by colorspace converter 60 of imaging apparatus 12 and imaging system 10 for performing color conversion. Signature color data lookup table 64 is specifically associated with the present invention calibration method, forming an inventive component of the composite color conversion lookup table 66 used in the color conversion process. As shown in FIG. 2, for example, colorspace converter 60 converts input RBG color data for a displayed or scanned image into color shift corrected CMYK output data that may be printed by print engine 20 using composite color conversion lookup table 66, hence using signature color data lookup table 64 and standard color conversion lookup table 62.

Standard color conversion lookup table 62 incorporates color conversion data to support color conversion via composite color conversion lookup table 66 for multiple color formats and the multiple types of printing substrate 44. Color formats supported by standard color conversion lookup table 62 and signature color data lookup table 64, hence composite color conversion lookup table 66, include, for example, monochrome K output using true black ink only, CMY color output with process black, also known as composite black, which is formed by using a combination of color inks, and CMYK color printing using a combination of color inks and true black ink.

Signature color data lookup table 64 is a multidimensional lookup table having at least three dimensions that includes multidimensional color data for production printing cartridge 22 expressed in a device independent CIELAB colorspace form. Alternatively, signature color data lookup table 64 may be in the form of multidimensional CIEXYZ device-independent colorspace data. However, the multidimensional color data of signature color data lookup table 64 may be expressed in any convenient device-dependent or device-independent colorspace. It will be understood that signature color data lookup table 64 may also include other data, such as spectral data.

Signature color data lookup table 64 represents the "signature" colors of production printing cartridge 22, such as, for example, the individual color output characteristics of the particular production printing cartridge 22. The signature colors of a cartridge are a small set of colors that can be used to characterize the cartridge, or to classify the cartridge into a class of cartridges with similar color characteristics.

In the embodiment described here, the signature color data is arranged in signature color data lookup table 64 in an ordered format for access by colorspace converter 60, wherein the order of the data allows colorspace converter 60 to correlate the data of signature color data lookup table 64 with the similarly ordered data of standard color conversion lookup table 62 in defining composite color conversion lookup table 66.

Each of standard color conversion lookup table 62, signature color data lookup table 64, and composite color conversion lookup table 66 may also be in the form of groups of polynomial functions capable of providing the same multidimensional output as if in the form of lookup tables.

Figure 3A:
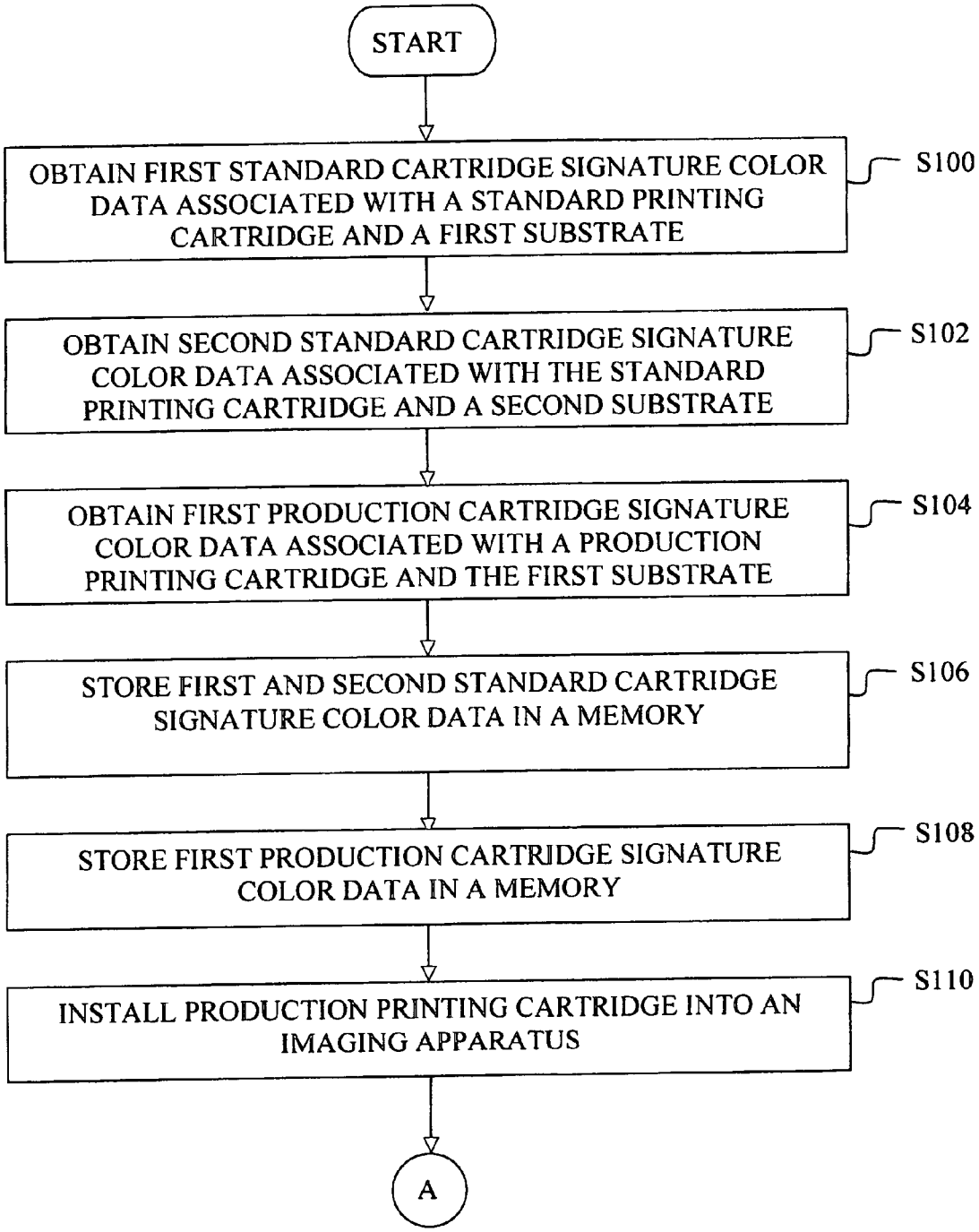
FIGS. 3A and 3B show a flowchart depicting a method according to the present invention.
Figure 3B:
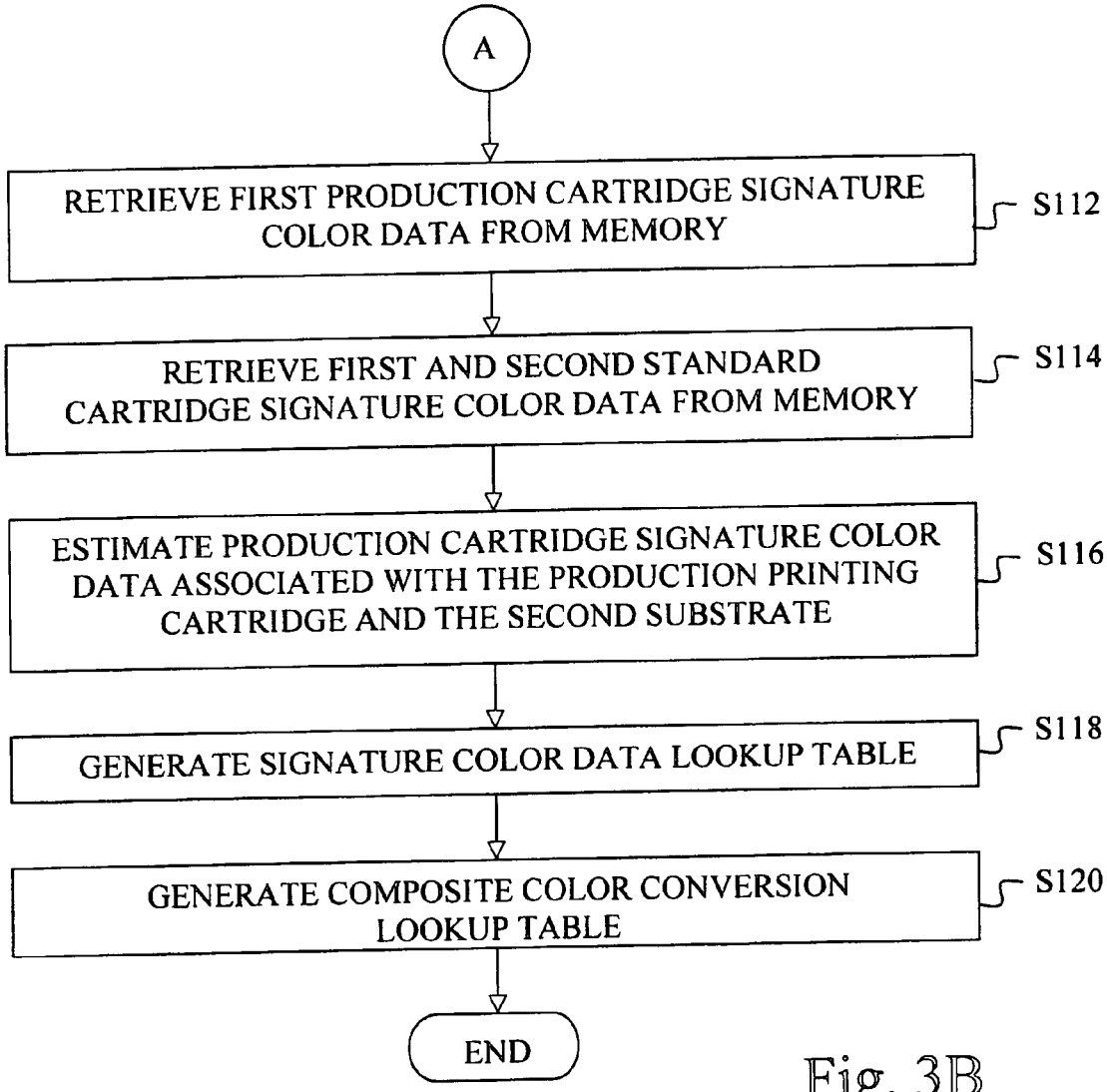

Referring now to FIGS. 3A and 3B, there is generally depicted a method for calibrating a production printing cartridge 22 for use in an imaging system 10. Although the method is depicted as flowing linearly from step S100 to step S120, it will be understood that the present invention is not so limited, and hence, the disclosed steps may be performed in any suitable sequence without departing from the scope of the present invention.

At step S100, first standard cartridge signature color data 70 associated with a standard printing cartridge 72 and a first substrate, such as standard substrate 68, is obtained. Step S100 is typically performed at the factory, e.g., by the manufacturer of production printing cartridge 22, and includes printing a first plurality of standard cartridge signature color test patches 74 using standard substrate 68 and standard printing cartridge 72, and measuring plurality of standard cartridge signature color test patches 74 with a spectrophotometer to obtain first standard cartridge signature color data 70 in the form of CIELAB data.

Figure 4:
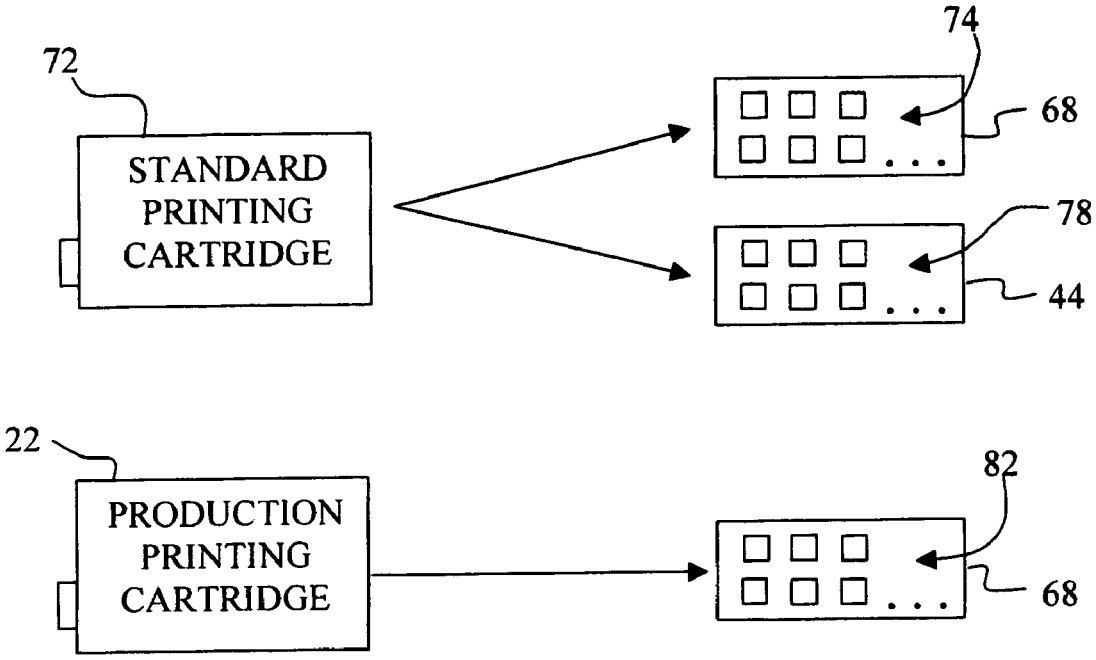
FIG. 4 is a diagram depicting the printing of test patches used to obtain signature color data according to the present invention.
Figure 5:
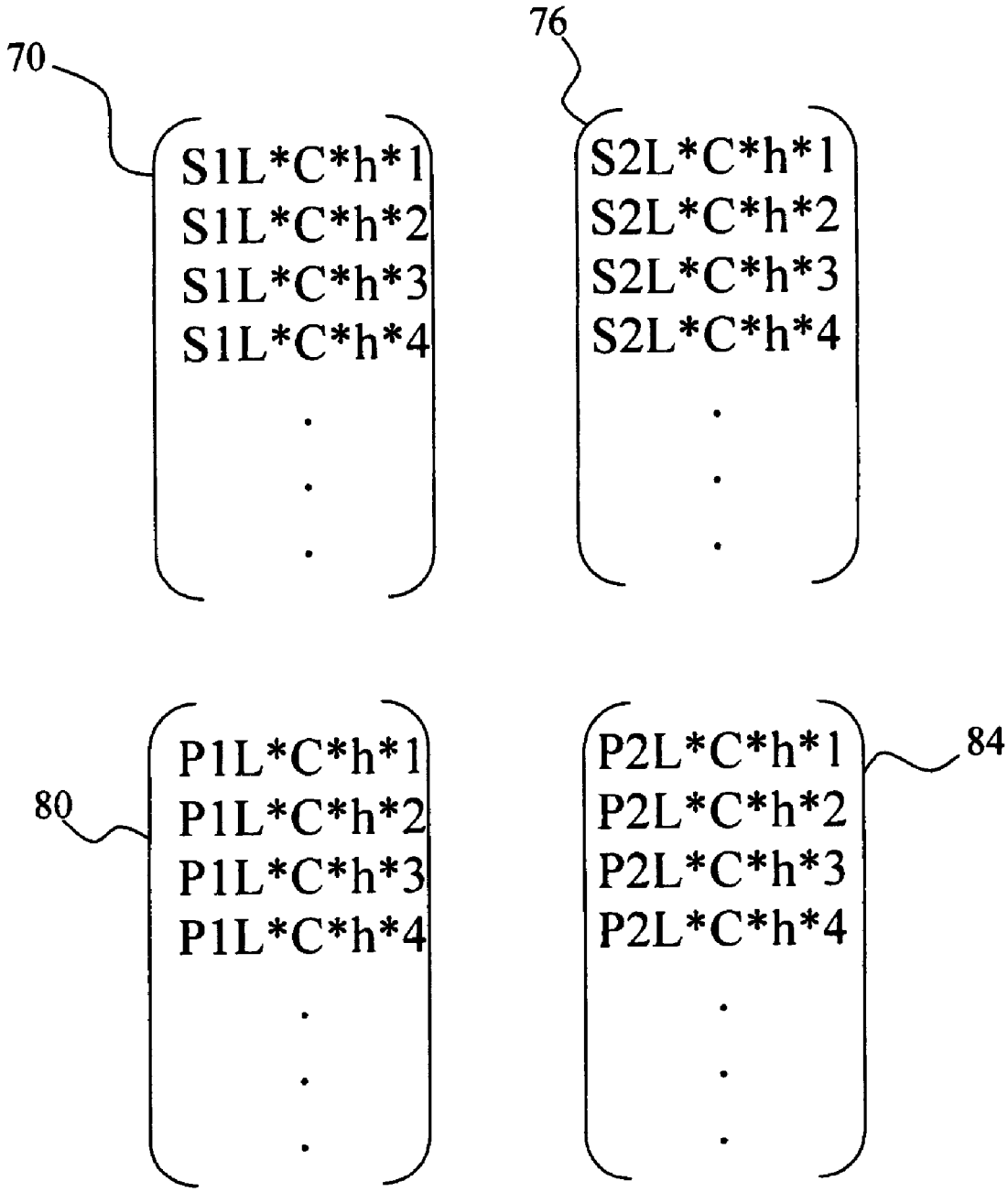
FIG. 5 is a graphical representation of signature color data employed by the present invention.

Referring now to FIG. 4, standard printing cartridge 72 is diagrammatically depicted as printing plurality of standard cartridge signature color test patches 74 on standard substrate 68, and referring to FIG. 5, first standard cartridge signature color data 70 is depicted as being CIELAB device-independent L*C*h* color data. Standard printing cartridge 72 is in the form of an average production printing cartridge 22, and is used for creating default color tables for each factory-supported substrate, such as standard color conversion lookup table 62. Accordingly, standard printing cartridge 72 is normally selected at the middle of the cartridge-to-cartridge color variations. Standard substrate 68 is a calibration paper, different from printing substrate 44, and may be a low cost paper used for calibrating production printing cartridge 22, and is preferably less expensive than printing substrate 44. Standard substrate 68 may be in the form of any commercially available or custom manufactured print medium. Alternatively, it is contemplated that standard substrate 68 may be the same as printing substrate 44.

Accordingly, first standard cartridge signature color data 70 represents standardized color data reflecting a nominal production printing cartridge 22 as printing on standard substrate 68. It is assumed that the measured variation in signature color data due to variations in standard substrate 68, such as variations in ink absorption, substrate dye variations, substrate composition variations, and variations in substrate light absorption and/or reflectivity characteristics, is negligible. Hence, as part of the calibration process described herein, any such variations are presumed to consist essentially of variations due to differences between the printing cartridges sought to be calibrated, such as between one production printing cartridge 22 and another.

The signature colors are defined in terms of display monitor 50 RGB colors rather than the print engine 20 CMYK colors since the former has the minimum number of colorants used in full color reproduction; colors of other color reproduction systems, e.g., CMYK, can be mathematically reconstructed as combinations of RGB colors, no matter how many actual colorants the color reproduction system employs.

The procedure for selecting signature colors for printing plurality of standard cartridge signature color test patches 74 is as follows: along each RGB primary color axis (R, G, or B), n even-spaced points over the whole range are selected. The number of all combinations of the n points will be $n^3$. This includes the individual channel properties and their cross talks. Since the individual channel properties are very important, m additional even-spaced points between each set of two neighboring points along each primary axis are selected, for a total of m(n−1) additional points for each axis. Thus, the total number (N) of the signature colors is given by:

$$N=n^3+3m(n-1) \quad \text{(Equation 1)}$$

In a typical monitor, such as display monitor 50, over 16 million RGB colors are available. Theoretically, the more colors selected as signature colors, the more accurate the color correction will be. However, other considerations usually affect the amount of signature colors that are selected, for example, cost considerations due to measuring time, memory size required to store the signature color data, etc., and system response time or system errors due to increased computational complexity. Accordingly, a relatively small number of signature colors is typically selected. For example, the inventors have discovered that setting n=3, and m=1, for a total of N=33 signature colors, works well for a glossy printing substrate 44. In other color reproduction applications, setting n=5, and m=0, for a total of N=125 signature colors has provided positive results. It may be appreciated by those skilled in the art that the number of signature colors to be selected will depend upon color correction accuracy requirements, as well as the particular applications of imaging apparatus 12 and production printing cartridge 22 for which the color shift correction is desired.

Referring again to FIG. 3A, at step S102, second standard cartridge signature color data 76 associated with standard printing cartridge 72 and a second substrate, i.e., printing substrate 44, is obtained. If printing substrate 44 is different from standard substrate 68, printing substrate 44 has different printing characteristics relative to standard substrate 68 that affect the color quality and color gamut of a printed image. For example printing substrate 44 may have different ink absorption characteristics, different surface characteristics such as roughness/smoothness characteristics and/or the presence or absence of a coating, different substrate light absorption, transmission, and/or reflectivity characteristics, and/or may employ different substrate dyes and/or different substrate compositions that affect the visible characteristics of images as printed on printing substrate 44.

Step S102 is performed at the factory, and includes printing a plurality of standard cartridge signature color test patches 78 using printing substrate 44 and standard printing cartridge 72, and measuring plurality of standard cartridge signature color test patches 78 with a spectrophotometer to obtain second standard cartridge signature color data 76 in the form of CIELAB data.

Referring now to FIG. 4, standard printing cartridge 72 is diagrammatically depicted as printing plurality of standard cartridge signature color test patches 78 on printing substrate 44, and referring to FIG. 5, second standard cartridge signature color data 76 is depicted as being CIELAB device-independent L*C*h* color data.

The procedure for selecting signature colors for printing plurality of standard cartridge signature color test patches 78 is the same as that used correspondingly for plurality of standard cartridge signature color test patches 74 in step S100. Step S102 is performed for each of the types of printing substrate 44, so that second standard cartridge signature color data 76 includes signature color data for each factory-supported substrate. Accordingly, second standard cartridge signature color data 76 accommodates printing with many types of printing substrate 44, such as plain paper, fabric, photo paper, coated ink jet paper, greeting card stock, transparency stock for use with overhead projectors, iron-on transfer material for use in transferring an image to an article of clothing, and back-lit film for use in creating advertisement displays and the like.

Referring again to FIG. 3A, at step S104, first production cartridge signature color data 80 associated with production printing cartridge 22 and standard substrate 68 is obtained. Production printing cartridge 22 is a standard supply item for imaging apparatus 12, and is representative of a printing cartridge typically produced in great quantities by the manufacturer of imaging apparatus 12 for use in imaging devices such as imaging apparatus 12. As with steps S100 and S102, step S104 is typically performed at the factory, e.g., by the manufacturer of production printing cartridge 22, and includes printing a plurality of production cartridge signature color test patches 82 using standard substrate 68 and production printing cartridge 22, and measuring plurality of production cartridge signature color test patches 82 with a spectrophotometer to obtain first production cartridge signature color data 80 in the form of CIELAB data. Step S104 is performed at the factory for each production printing cartridge 22 that is manufactured by the manufacturer of imaging apparatus 12.

Referring now to FIG. 4, production printing cartridge 22 is diagrammatically depicted as printing plurality of production cartridge signature color test patches 82 on standard substrate 68, and referring to FIG. 5, first production cartridge signature color data 80 is depicted as being CIELAB device-independent L*C*h* color data.

The procedure for selecting signature colors for printing plurality of production cartridge signature color test patches 82 is the same as that used correspondingly for plurality of standard cartridge signature color test patches 74 in step S100.

Referring again to FIG. 3A, at step S106, first standard cartridge signature color data 70 and second standard cartridge signature color data 76 are stored in a memory accessible by imaging system 10, such as memory 36 of controller 18 and/or memory 46 of host 14. First standard cartridge signature color data 70 and second standard cartridge signature color data 76 may be provided as part of imaging driver 58.

At a step S108, first production cartridge signature color data 80 is stored in a memory accessible by imaging system 10, such as cartridge memory 24 or offsite memory 34 of offsite computer 32, both of which are accessible by imaging apparatus 12 alone, or in combination with the balance of imaging system 10. Because the number of signature colors is relatively small, e.g., N=33, as set forth above first production cartridge signature color data 80 requires only a small amount of memory, allowing first production cartridge signature color data 80 to be stored in inexpensive, low capacity memory systems, and allowing for fast processing, as well as fast transference of color correction data between computer systems, e.g., via networks, as well as between imaging system 10 or imaging apparatus 12 components. In particular, if stored in cartridge memory 24, the small amount of first production cartridge signature color data 80 requires only a small amount of storage space, thus reducing the cost of cartridge memory 24.

At step S110, production printing cartridge 22 is installed into imaging apparatus 12. Step S110 is typically performed by the end user of imaging apparatus 12. The installation of production printing cartridge 22 is detected by imaging apparatus 12 using processes known in the art. Alternatively, it is contemplated that the installation of production printing cartridge 22 may be detected by imaging system 10 operating alone or in conjunction with imaging apparatus 12.

Referring now to FIG. 3B, at step S112, first production cartridge signature color data 80 is retrieved from the memory in which it was stored in step S108. If first production cartridge signature color data 80 was stored in offsite memory 34 of offsite computer 32, it is retrieved by downloading via network 28. First production cartridge signature color data 80 is retrieved by imaging apparatus 12. Alternatively, it is contemplated that first production cartridge signature color data 80 may be retrieved by imaging system 10 operating alone, or in conjunction with imaging apparatus 12.

At step S114, first standard cartridge signature color data 70 and second standard cartridge signature color data 76 are retrieved from the memory in which they were stored in step S106.

At step S116, second production cartridge signature color data 84 associated with production printing cartridge 22 and printing substrate 44 is estimated based on the first standard cartridge signature color data 70, second standard cartridge signature color data 76, and first production cartridge signature color data 80. The estimation of second production cartridge signature color data is performed by imaging apparatus 12. It is also contemplated that step S116 is performed by host 14 of imaging system 10, alone, or in conjunction with imaging apparatus 12.

The estimation of second production cartridge signature color data 84 is described in the following paragraphs. Although a specific procedure for estimating second production cartridge signature color data 84 is described, it is understood that the present invention is not so limited. Accordingly, it will be appreciated by those skilled in the art that other procedures may be employed to estimate second production cartridge signature color data 84 without departing from the scope of the present invention.

In describing the estimation process, the following subscripts are employed: "1", "i," "j", and "s". Subscript "1" pertains to standard substrate 68, subscript "i" pertains to production printing cartridge 22, subscript "j" pertains to printing substrate 44, and subscript "s" pertains to standard printing cartridge 72.

As described herein, the estimation process makes reference to colorant points in the RGB colorspace, and makes reference to L*, C*, and h* values in the CIELAB colorspace, both of which are employed in the following description as a tool for explaining the derivation of the final estimation results disclosed below. In using this "explanation tool", the RGB points are input points that correspond to input values such as would be provided as input to colorspace converter 60, and the CIELAB L*, C*, and h* values correspond to values of lightness, chroma, and hue angle, such as that might be measured from the output of a printing cartridge on a substrate, such as in the combinations of production printing cartridge 22 and standard printing cartridge 72 with respect to printing substrate 44 and standard substrate 68 as described below.

The signature color for production printing cartridge 22 as printed on standard substrate 68 is given by the equation, $$\xi_{i1}=f_{i1}(r,g,b) \quad \text{(Equation 2)}$$

where $\xi_{i1}$ is a color point ($L^*_{i1}$, $C^*_{i1}$, $h^*_{i1}$) in the CIELAB device-independent colorspace, $L^*_{i1}$ is the lightness component, $C^*_{i1}$ is the chroma component, and $h^*_{i1}$ is the hue angle component, (r, g, b) is a colorant point in the RGB device-dependent colorspace, and $f_{i1}$ denotes that $\xi_{i1}$ is a function of (r, g, b), implemented as a lookup table or a group of polynomial functions by using the signature colors of the cartridge. Each of the CIELAB device-independent colorspace and the RGB device-dependent colorspace encompass all colors, including those colors associated with first standard cartridge signature color data 70, second standard cartridge signature color data 76, first production cartridge signature color data 80, and second production cartridge signature color data 84.

In order to estimate second production cartridge signature color data 84 associated with production printing cartridge 22 and printing substrate 44, the known quantities, i.e., first standard cartridge signature color data 70, second standard cartridge signature color data 76, and first production cartridge signature color data 80, are mathematically correlated, so that their relationship to second production cartridge signature color data 84 can be derived. Accordingly, the signature color of standard printing cartridge 72 on standard substrate 68 is given by the equation, $$\xi_{s1}=f_{s1}(r,g,b). \quad \text{(Equation 3)}$$

The signature color of the standard printing cartridge 72 on printing substrate 44 is given by the equation, $$\xi_{sj}=f_{sj}(r,g,b). \quad \text{(Equation 4)}$$

When a production printing cartridge 22 is used to print colors on printing substrate 44, the color may change due to the difference between production printing cartridge 22 and standard printing cartridge 72. The signature color ($\xi_{ij}$) of production printing cartridge 22 on printing substrate 44 is unknown since the production printing cartridge 22 is not calibrated on printing substrate 44 in manufacturing, and hence, must be estimated. The signature color of production printing cartridge 22 on printing substrate 44 may be represented by the equation, $$\xi_{ij}=f_{ij}(r,g,b). \text{ (to be estimated)} \quad \text{(Equation 5)}$$

In order to perform color correction for production printing cartridge 22, the unknown signature color $\xi_{ij}=(L^*_{ij}, C^*_{ij}, h^*_{ij})$, i.e., second production cartridge signature color data 84 associated with production printing cartridge 22 and printing substrate 44, is estimated using three estimation components.

The first estimation component considers that a color ratio/difference between two substrates linearly changes in a small colorspace neighborhood from one printing cartridge to another. Hence, a lightness ratio, chroma ratio, and a hue angle difference between first standard cartridge signature color data 70 and second standard cartridge signature color data 76 is determined. The estimate of second production cartridge signature color data 84 is then based on the determined lightness ratio, chroma ratio, and hue angle difference.

Considering Equations 3 and 4, both $\xi_{s1}$ and $\xi_{sj}$ are obtained using the same standard printing cartridge 72, but on standard substrate 68 and printing substrate 44, respectively. The ratios of lightness and chroma and the hue angle difference as between standard substrate 68 and printing substrate 44 for a given RGB color point are represented by the following equations:

$$\lambda_{sj1} = \frac{L^*_{sj}}{L^*_{s1}} \quad \text{(Equation 6)}$$

$$\gamma_{sj1} = \frac{C^*_{sj}}{C^*_{s1}} \quad \text{(Equation 7)}$$

$$\delta_{sj1} = h^*_{sj} - h^*_{s1} \quad \text{(Equation 8)}$$

Considering Equations 2 and 5, both $\xi_{i1}$ and $\xi_{ij}$ are obtained using the same production printing cartridge 22, but on standard substrate 68 and printing substrate 44, respectively. The ratios of lightness and chroma and hue angle difference between printing substrate 44 and standard substrate 68 are given by:

$$\lambda_{ij1} = \frac{L^*_{ij}}{L^*_{i1}} \quad \text{(Equation 9)}$$

$$\gamma_{ij1} = \frac{C^*_{ij}}{C^*_{i1}} \quad \text{(Equation 10)}$$

$$\delta_{ij1} = h^*_{ij} - h^*_{i1} \quad \text{(Equation 11)}$$

Both sets of Equations 6–8 and Equations 9–11 represent the color ratios/differences between standard substrate 68 and printing substrate 44, but Equations 6–8 pertain to the standard printing cartridge 72, and Equations 9–11 pertain to production printing cartridge 22.

Since the cartridge color shifts normally vary in a relatively small neighborhood in a given color space, the lightness ratios, chroma ratios, and hue angle differences may be considered to linearly change in the small neighborhood from one cartridge to another. Accordingly, with the first estimation component consideration of linear change, the lightness ratio, chroma ratio, and hue angle difference values of production printing cartridge 22 are scaled from the lightness ratio, chroma ratio, and hue angle difference values of standard printing cartridge 72 in conjunction with standard substrate 68 and printing substrate 44. The following equations are thus obtained:

$$\lambda_{ijl} = \rho_L \lambda_{sjl} \quad \text{(Equation 12)}$$

$$\gamma_{ijl} = \rho_C \gamma_{sjl} \quad \text{(Equation 13)}$$

$$\delta_{ijl} = \rho_h \delta_{sjl} \quad \text{(Equation 14)}$$

where, $\rho_L$, $\rho_C$ and $\rho_h$ are constants.

Combining Equations 6–14 gives the following, Equations 15–17, which together define a first signature color data component that is determined based on scaling each of the lightness ratio, chroma ratio, and hue angle difference of standard printing cartridge 72 in conjunction with standard substrate 68 and printing substrate 44.

$$L^*_{ij} = \frac{\rho_L L^*_{sj}}{L^*_{sl}} L^*_{il} \quad \text{(Equation 15)}$$

$$C^*_{ij} = \frac{\rho_C C^*_{sj}}{C^*_{sl}} C^*_{il} \quad \text{(Equation 16)}$$

$$h^*_{ij} = \rho_h (h^*_{sj} - h^*_{sl}) + h^*_{il} \quad \text{(Equation 17)}$$

The first signature color data component, given by Equations 15–17, is thus used to estimate second production cartridge signature color data 84, based on first standard cartridge signature color data 70, second standard cartridge signature color data 76, and first production cartridge signature color data 80.

The second component used to estimate the unknown signature color $\xi_{ij}=(L^*_{ij},C^*_{ij},h^*_{ij})$, i.e., second production cartridge signature color data 84 associated with production printing cartridge 22 and printing substrate 44 is described next.

The second estimation component considers that the change of the color ratio/difference between two substrates at a point in colorspace caused by cartridge color shifts is similar to the color ratio/difference of the same cartridge changing from one RGB point in the colorspace to another RGB point in a small neighborhood in the colorspace. Thus, a lightness ratio is determined at a first RGB input point, (r1, g1, b1), in the colorspace using a lightness ratio function, a chroma ratio is determined at the first RGB input point using a chroma ratio function, and a hue angle difference is determined at the first RGB input point using a hue angle difference function. The second production cartridge signature color data 84 is then determined, based on evaluating at a second RGB input point, (r2, g2, b2), in the colorspace each of the lightness ratio function, the chroma ratio function, and the hue angle difference function.

Accordingly, from Equations 6–8, for a given RGB point, $\lambda_{sj1}$, $\gamma_{sj1}$ and $\delta_{sj1}$ are represented as follows:

$$\lambda_{sj1}=g_1(r,g,b) \quad \text{(Equation 18)}$$

$$\gamma_{sj1}=g_2(r,g,b) \quad \text{(Equation 19)}$$

$$\delta_{sj1}=g_3(r,g,b) \quad \text{(Equation 20)}$$

where, $g_1$, $g_2$, and $g_3$ denote the functional relationships implemented as lookup tables or groups of polynomial functions, i.e., the lightness ratio function, the chroma ratio function, and the hue angle difference function, respectively. These relationships are generated using standard printing cartridge 72, standard substrate 68, and printing substrate 44. Given the same substrates, if production printing cartridge 22 is used, the output of functional relationships $g_1$, $g_2$, and $g_3$ will be changed. Considering the change to be similar to using the same cartridge, but changing from the first RGB point to the second RGB input point, for a given RGB input point, (r, g, b), the estimated values $\lambda_{ij1}$, $\gamma_{ij1}$, $\delta_{ij1}$ (Equations 9–11) with production printing cartridge 22 will be close to the values $\lambda'_{sj1}$, $\gamma'_{sj1}$, $\delta'_{sj1}$ with the standard printing cartridge 72 corresponding to (r+dr, g+dg, b+db) in Equations 18–20. The displacements dr, dg, and db are caused by production printing cartridge 22 being different from standard printing cartridge 72, for example, due to manufacturing variations, and simulate a change from the first RGB input point to the second RGB input point. Displacements dr, dg, and db can be found by (1) Find $\xi_{i1}$ of production printing cartridge 22 in Equation 2 for a given RGB point, (r, g, b); and (2) replacing $\xi_{s1}$ of the standard printing cartridge 72 in Equation 3 with $\xi_{i1}$ to find (r+dr, g+dg, b+db) by inverse computation. Subtracting (r, g, b) from (r+dr, g+dg, b+db) thus yields displacements dr, dg, and db.

Thus, the lightness ratio, chroma ratio, and hue angle difference for production printing cartridge 22 are given by:

$$\lambda_{ij1}=k_L\lambda'_{sj1} \quad \text{(Equation 21)}$$

$$\gamma_{ij1}=k_C\gamma'_{sj1} \quad \text{(Equation 22)}$$

$$\delta_{ij1}=k_h\delta'_{sj1} \quad \text{(Equation 23)}$$

where, $k_L$, $k_C$ and $k_h$ are constants; and $\lambda'_{sj1}$, $\gamma'_{sj1}$, and $\delta'_{sj1}$ are computed with (r+dr, g+dg, b+db) using Equations 18–20.

Combining Equations 9–11 and 21–23 gives Equations 24–26, which together define a second signature color data component:

$$L^*_{ij}=k_L\lambda'_{sj1}L^*_{i1} \quad \text{(Equation 24)}$$

$$C^*_{ij}=k_C\gamma'_{sj1}C^*_{i1} \quad \text{(Equation 25)}$$

$$h^*_{ij}=k_h\delta'_{sj1}+h^*_{i1} \quad \text{(Equation 26)}$$

The second signature color data component is determined based on evaluating at the second RGB input point in the colorspace each of the lightness ratio function, the chroma ratio function, and the hue angle difference function.

The third component in estimating the unknown signature color $\xi_{ij}=(L^*_{ij},C^*_{ij},h^*_{ij})$, i.e., second production cartridge signature color data 84 associated with production printing cartridge 22 and printing substrate 44 is described next.

The inventors discovered that using a weighted average of the first and second estimation components, as given by Equations 15–17 and 24–26, respectively, yields desirable results. Accordingly, weights, or weighting values, are assigned to the first and second estimation components. Weights $w'_L$, $W'_C$, and $w'_h$ are designated for use with respect to Equations 15–17 and weights, $(1-w'_L)$, $(1-w'_C)$, and $(1-w'_h)$ are designated for use with respect to Equations 24–26. Simplifying, $w_{L1}/=w'_L\rho_L$, $w_{L2}=(1-w'_L)k_L$, $w_{C1}=w'_C\rho_C$, $w_{C2}=(1-w'_C)k_C$, $w_{h1}=w'_h\rho_h$, and $w_{h2}=(1-w'_h)k_h$. Thus, the weighted average of the first and second estimation components is given by:

$$L^*_{ij} = \left(w_{L1}\frac{L^*_{sj}}{L^*_{s1}} + w_{L2}\lambda'_{sj1}\right)L^*_{i1} \quad \text{(Equation 27)}$$

$$C^*_{ij} = \left(w_{C1}\frac{C^*_{sj}}{C^*_{s1}} + w_{C2}\gamma'_{sj1}\right)C^*_{i1} \quad \text{(Equation 28)}$$

$$h^*_{ij} = w_{h1}(h^*_{sj} - h^*_{s1}) + w_{h2}\delta'_{sj1} + h^*_{i1} \quad \text{(Equation 29)}$$

The constants, $w_{L1}$, $w_{L2}$, $w_{C1}$, $w_{C2}$, $w_{h1}$, and $w_{h2}$ in Equations 27–29, are readily determined. For example, the constants can be obtained by a training process, in which the signature colors of different cartridges, e.g., production printing cartridge 22, on printing substrate 44 are measured and then compared to the estimated values given by Equations 27–29 using a series of training values of the constants. Those constants corresponding to the minimum error between the measured and estimated color values for each printing substrate 44 are employed by imaging driver 58 in estimating second production cartridge signature color data 84 associated with production printing cartridge 22 and printing substrate 44, $\xi_{ij}=(L^*_{ij},C^*_{ij},h_{ij})$. It was discovered that different types of printing substrate 44 might have different optimized constants. For glossy paper, it was found that the following constants can give good results:

$$w_{L1}=w_{C1}=w_{h1}=0.85 \quad \text{(Equation 30)}$$

$$w_{L2}=W_{C2}=w_{h2}=0.15 \quad \text{(Equation 31)}$$

Accordingly, Equations 27–29, in conjunction with the constants, $w_{L1}$, $w_{L2}$, $w_{C1}$, $w_{C2}$, $w_{h1}$, and $w_{h2}$, yield second production cartridge signature color data 84, based on a weighted average of the first signature color data component given by equations 15–17, and the second signature color data component given by Equations 24–26.

Referring again to FIG. 3B, at step S118, signature color data lookup table 64 is generated, based on second production cartridge signature color data 84 estimated in step S116. Step S118 is performed by imaging apparatus 12, but alternatively, may be performed by imaging system 10, or at the factory. By generating signature color data lookup table 64, second production cartridge signature color data 84 is rendered into an form suitable for use by colorspace converter 60.

At step S120, signature color data lookup table 64 is combined with standard color conversion lookup table 62 to generate composite color conversion lookup table 66 for use in printing with production printing cartridge 22 on printing substrate 44. Step S120 is performed by imaging apparatus 12, but alternatively, may be performed by imaging system 10, e.g., host 14 operating alone or in conjunction with imaging apparatus 12.

It will be appreciated by those skilled in the art that the method of the present invention reduces the cost of production printing cartridge 22, imaging apparatus 12, and imaging system 10 by eliminating the need to calibrate each production printing cartridge 22 on each type of printing substrate 44. Accordingly, by virtue of the use of a low cost standard substrate 68, the present invention saves cost associated with calibrating production printing cartridge using a higher cost printing substrate 44 in the form of photo paper, etc. In addition, the size of second production cartridge signature color data 84 is very small in comparison to a typical color conversion lookup table, and hence may be stored in a low capacity memory, hence a lower cost memory, which may be implemented as cartridge memory 24.

While this invention has been described with respect to an embodiment of the present invention, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A method for calibrating a production printing cartridge for use in an imaging system, comprising the steps of:

obtaining first standard cartridge signature color data associated with a standard printing cartridge and a first substrate;

obtaining second standard cartridge signature color data associated with said standard printing cartridge and a second substrate;

obtaining first production cartridge signature color data associated with said production printing cartridge and said first substrate; and estimating second production cartridge signature color data associated with said production printing cartridge and said second substrate based on said first standard cartridge signature color data, said second standard cartridge signature color data, and said first production cartridge signature color data.

2. The method of claim 1, wherein said obtaining said first standard cartridge signature color data includes:

printing a first plurality of test patches using said first substrate and said standard printing cartridge; and measuring said first plurality of test patches to obtain said first standard cartridge signature color data.

3. The method of claim 1, wherein said obtaining said second standard cartridge signature color data includes:

printing a second plurality of test patches using said second substrate and said standard printing cartridge; and measuring said second plurality of test patches to obtain said second standard cartridge signature color data.

4. The method of claim 1, wherein said obtaining said first production cartridge signature color data includes:

printing a third plurality of test patches using said first substrate and said production printing cartridge; and measuring said third plurality of test patches to obtain said first production cartridge signature color data.

5. The method of claim 1, wherein said first substrate is different from said second substrate.

6. The method of claim 1, wherein:

said first substrate is calibration paper, and said second substrate is one of the group consisting of plain paper, photo quality paper, iron-on-transfer material, coated paper, back-lit film, greeting card stock, transparency material, and fabric.

7. The method of claim 1, wherein said imaging system includes an imaging apparatus, further comprising the steps of:

storing said first standard cartridge signature color data and said second standard cartridge signature color data into a memory accessible by said imaging system, installing said production printing cartridge into said imaging apparatus; and retrieving said first standard cartridge signature color data and said second standard cartridge signature color data from said memory.

8. The method of claim 1, further comprising the step of:

generating a signature color data lookup table based on said second production cartridge signature color data.

9. The method of claim 8, wherein said imaging system includes an imaging apparatus accessing a standard color conversion lookup table, further comprising the step of:

combining said signature color data lookup table with said standard color conversion lookup table to generate a composite color conversion lookup table for use in printing with said production printing cartridge on said second substrate.

10. The method of claim 9, further comprising the steps of:

storing said first production cartridge signature color data in a memory accessible by said imaging system;

installing said production printing cartridge into said imaging apparatus; and retrieving said first production cartridge signature color data from said memory.

11. The method of claim 10, wherein said memory is a cartridge memory of said production printing cartridge.

12. The method of claim 10, wherein said memory is an offsite memory accessed using a network.

13. The method of claim 1, comprising the further steps of:

determining a lightness ratio from said first standard cartridge signature color data and said second standard cartridge signature color data;

determining a chroma ratio from said first standard cartridge signature color data and said second standard cartridge signature color data; and determining a hue angle difference from said first standard cartridge signature color data and said second standard cartridge signature color data, wherein said estimating said second production cartridge signature color data is based on said lightness ratio, said chroma ratio, and said hue angle difference.

14. The method of claim 13, wherein said second production cartridge signature color data is based on scaling each of said lightness ratio, said chroma ratio, and said hue angle difference.

15. The method of claim 13, wherein:

said lightness ratio is determined for a first input point in a colorspace using a lightness ratio function, said chroma ratio is determined at said first input point using a chroma ratio function, and said hue angle difference is determined at said first input point using a hue angle difference function; and said second production cartridge signature color data is based on evaluating at a second input point in said colorspace each of said lightness ratio function, said chroma ratio function, and said hue angle difference function.

16. The method of claim 15, wherein:

a first signature color data component is determined based on scaling each of said lightness ratio, said chroma ratio, and said hue angle difference;

a second signature color data component is based on evaluating at said second point in said colorspace each of said lightness ratio function, said chroma ratio function, and said hue angle difference function; and said second production cartridge signature color data is based on a weighted average of said first signature color data component and said second signature color data component.

17. An imaging apparatus, comprising:

a print engine configured to mount a production printing cartridge; and a controller communicatively coupled to said print engine, said controller executing instructions to perform the steps of:

acquiring first standard cartridge signature color data associated with a standard printing cartridge and a first substrate;

acquiring second standard cartridge signature color data associated with said standard printing cartridge and a second substrate;

acquiring first production cartridge signature color data associated with said production printing cartridge and said first substrate; and estimating second production cartridge signature color data associated with said production printing cartridge and said second substrate based on said first standard cartridge signature color data, said second standard cartridge signature color data, and said first production cartridge signature color data.

18. The imaging apparatus of claim 17, wherein said first substrate is different from said second substrate.

19. The imaging apparatus of claim 17, wherein:

said first substrate is calibration paper, and said second substrate is one of the group consisting of plain paper, photo quality paper, iron-on-transfer material, coated paper, back-lit film, greeting card stock, transparency material, and fabric.

20. The imaging apparatus of claim 17, said controller further executing instructions to perform the step of:

generating a signature color data lookup table based on said second production cartridge signature color data.

21. The imaging apparatus of claim 20, said controller also accessing a standard color conversion lookup table and further executing instructions to perform the step of:

combining said signature color data lookup table with said standard color conversion lookup table to generate a composite color conversion lookup table for use in printing with said production printing cartridge on said second substrate.

22. The imaging apparatus of claim 17, wherein said estimating step is performed by:

using a lightness ratio based on said first standard cartridge signature color data and said second standard cartridge signature color data;

using a chroma ratio based on said first standard cartridge signature color data and said second standard cartridge signature color data; and using a hue angle difference based on said first standard cartridge signature color data and said second standard cartridge signature color data, wherein said estimating said second production cartridge signature color data is based on said lightness ratio, said chroma ratio, and said hue angle difference.

23. The imaging apparatus of claim 22, wherein said estimating said second production cartridge signature color data is based on scaling each of said lightness ratio, said chroma ratio, and said hue angle difference.

24. The imaging apparatus of claim 22, wherein:

said lightness ratio is determined for a first input point in a colorspace using a lightness ratio function, said chroma ratio is determined at said first input point using a chroma ratio function, and said hue angle difference is determined at said first input point using a hue angle difference function; and said second production cartridge signature color data is based on evaluating at a second input point in said colorspace each of said lightness ratio function, said chroma ratio function, and said hue angle difference function.

25. The imaging apparatus of claim 24, wherein in said estimating said second production cartridge signature color data:

a first signature color data component is determined based on scaling each of said lightness ratio, said chroma ratio, and said hue angle difference;

a second signature color data component is based on said evaluating at said second input point in said colorspace each of said lightness ratio function, said chroma ratio function, and said hue angle difference function; and said second production cartridge signature color data is based on a weighted average of said first signature color data component and said second signature color data component.

26. The imaging apparatus of claim 22, said imaging apparatus further comprising an imaging driver, wherein said imaging driver includes said first standard cartridge signature color data and said second standard cartridge signature color data, and wherein said acquiring said first standard cartridge signature color data and said acquiring said second standard cartridge signature color data includes generating said lightness ratio, generating said chroma ratio, and generating said hue angle difference.

27. The imaging apparatus of claim 22, said imaging apparatus further comprising an imaging driver, wherein:

said imaging driver includes said lightness ratio, said chroma ratio, and said hue angle difference, wherein said acquiring said first standard cartridge signature color data and said acquiring said second standard cartridge signature color data includes accessing said lightness ratio, accessing said chroma ratio, and accessing said hue angle difference.

28. The imaging apparatus of claim 17, wherein a memory accessible by said imaging apparatus stores said first production cartridge signature color data, and wherein said acquiring said first production cartridge signature color data includes retrieving said first production cartridge signature color data from said memory.

29. The imaging apparatus of claim 28, wherein said memory is a cartridge memory of said production printing cartridge.

30. The imaging apparatus of claim 28, wherein said memory is an offsite memory accessed using a network.

* * * * *